United States Patent [19]

Schaumann

[11] 4,261,069

[45] Apr. 14, 1981

[54] WATER WALKER

[76] Inventor: Peter H. Schaumann, 15 Jasmine La., Port St. Lucie, Fla. 33452

[21] Appl. No.: 947,571

[22] Filed: Oct. 2, 1978

Related U.S. Application Data

[60] Continuation-in-part of Ser. No. 792,571, May 2, 1977, Pat. No. 4,117,562, which is a continuation-in-part of Ser. No. 656,578, Feb. 9, 1976, abandoned, which is a division of Ser. No. 400,193, Sep. 21, 1973, Pat. No. 3,936,897.

[51] Int. Cl.[3] ..... A63C 15/00

[52] U.S. Cl. ..... 9/310 D; 114/288

[58] Field of Search ..... 9/310 D, 310 A, 310 E, 9/310 R, 310 B; 115/11, 14, 15, 16, 39; 114/61, 288, 289, 290

[56] References Cited

U.S. PATENT DOCUMENTS

| | | | |
|---|---|---|---|
| 2,153,939 | 4/1939 | Schaupp | 9/310 D |
| 3,031,696 | 5/1962 | Brabb | 9/310 D |
| 3,063,071 | 11/1962 | Van Vorst | 9/310 D |
| 3,121,892 | 2/1964 | Plumlee | 9/310 D |
| 3,284,824 | 11/1966 | Chymbur | 9/310 D |

*Primary Examiner*—Sherman D. Basinger

[57] ABSTRACT

A water walker which is attachable to a user's foot and which, when used in pairs, i.e., one walker for each of a user's feet, allows the user to move across the surface of a body of water while standing upright, includes a buoyant flotation member, a pair of spaced apart runners longitudinally extending along the bottom of the buoyant member, and at least one water control mechanism in the space between the runners. Each control mechanism includes opposed baffles which extend towards one another a distance less than one half the spacing between the runners, and a pivotable gate which is positioned to allow water to pass between the baffles when the walker is moved forward, but which is biased so as to be repositioned to prevent water from passing between the baffles once the walker has completed its forward movement. Each buoyant flotation member includes an overhang portion on the side thereof opposite the adjacent member to enhance the stability of the walker. Each of the buoyant flotation members also includes either an elongated indentation or an elongated protuberance on the side thereof facing the adjacent member for interconnection of the members in a vertical direction, and an interconnected pair of cables, each connected to the top of a respective member, act to limit diverging movement therebetween in a sideways direction.

3 Claims, 7 Drawing Figures

WATER WALKER

RELATED APPLICATIONS

The present application is a continuation-in-part application of U.S. patent application Ser. No. 792,571, filed May 2, 1977, now U.S. Pat. No. 4,117,562 which application in turn was a continuation-in-part application of U.S. patent application Ser. No. 656,578, filed Feb. 9, 1976, now abandoned, which application was a divisional application of U.S. patent application Ser. No. 400,193, filed Sept. 21, 1973 and now U.S. Pat. No. 3,936,897.

BACKGROUND OF THE INVENTION

The present invention relates to improved water walker devices which are individually adapted to be attached to the feet of a prospective user in order to support the user when in the water and concurrently allow the user to propel himself along the surface of the water while in a standing position. More specifically, the present invention is directed to improvements in certain of the types of water walkers described in my co-pending application Ser. No. 792,571.

As noted in my co-pending application Ser. No. 792,571, numerous devices have been previously developed for enabling individuals to walk on water, but many of these devices have been insufficiently stable or mobile for satisfactory use. In addition, even the devices which have had a reasonable amount of stability often have suffered from the problem of rear slippage, i.e., the slipping backward of the most forward walker as the rear walker is moved forward by the user. Indeed, such slippage, in addition to seriously retarding the forward movement of the user, in fact creates an inherent instability in the operation of the walkers.

In my co-pending application Ser. No. 792,571 I have shown water walkers which are not only quite stable and easy to steer, but also enable the user to walk on and/or step over objects floating in the water (or surmount such obstacles as sand bars or logs) without causing damage to the water walker. The water walkers are also constructed to be, among other things, subject to much less rearward slippage as compared to the water walkers of the prior art.

I have now discovered, however, that my water walkers can be made even more stable and subject to even less rearward slippage than can be achieved in accordance with the invention disclosed in my co-pending application, i.e., by utilizing certain structural modifications as will be presently described.

Accordingly, it is an object of the present invention to provide an improved water walker apparatus for enabling an individual to more easily walk on water with a greater degree of stability, and with less rearward slippage, than can be achieved in prior art devices.

SUMMARY OF THE INVENTION

According to the present invention the water walker apparatus includes a pair of elongated buoyant water walker assemblies, each of which is adapted to be attached to the respective foot of the prospective user. Each assembly includes a buoyant flotation member which has opposed, spaced apart runners positioned to extend longitudinally along the entire length of its bottom. The runner define therebetween a hollow channel which accordingly extends along their entire longitudinal length, with the hollow channel being open at both longitudinal ends. At least one control mechanism is arranged with the hollow channel between the runners which allows for movement of the assembly in a forward direction in the water, but which acts to prevent slippage of the assembly in a rearward direction.

Each noted assembly control mechanism located between the water walker runners comprises opposed baffles either attached to, or formed as part of, the respective longitudinally extending runners, which baffles extend towards one another a distance less than one half the spacing between the opposed runners, i.e., so as to leave a passageway therebetween, and each mechanism includes a gate attached to one of the baffles which is movable between a first position wherein the passgeway between the opposed baffles is left essentially unblocked, and a second position wherein the passageway between the opposed baffles is closed. The gate is so mounted that it will assume the first position when the water walker assembly is caused to move forward in the water by movement of the attached foot of the user; whereas it will tend to assume the second position when the walker assembly is either motionless in the water or moving slightly rearwardly (which occurs when the user moves the water walker assembly forward with his other foot). The hollow channel with control mechanism thus operates as a jet stream system generally allowing passage of water through the channel from front to back (bow to stern) while blocking passage of water in the opposite direction, and thereby easily enabling the user to move in a forward direction while substantially retarding rearward movement of the assembly and any resulting slippage which would otherwise occur.

Each of the baffles is shaped so as to cause a venturi effect on the water passing thereby from the front of the water walker assembly to the rear; thus, the baffles may be shaped in cross section as right angle triangles, with the hypotenuse sides thereof facing the front of the water walker assembly. The configuration of the opposed baffles enhances operation of the gate as will be discussed below.

The gate, which is attached to one of the opposed baffles, is biased so that although it will be easily capable of being positioned in its first position and thus leave essentially unblocked the passageway between the opposed baffles when the water walker assembly is being moved forward, once the forward motion stops, the gate will be immediately caused to move towards its second position due to the action of the biasing means, as well as the interaction of the opposed baffles on the water in the hollow channel, once forward motion of the water walker assembly is completed. Just as forward movement of the water walker is completed, the baffles, due to their configuration, will tend to cause the water in the hollow channel to move in a reverse direction through the hollow channel, i.e., from back to front thereof, in such a way as to cause an accelerated braking of the forward movement of the water walker assembly, i.e., cause an accelerated repositioning of the gate from its first to its second position.

In addition to the foregoing, the buoyant flotation member of each water walker is so formed that it has on the side opposite the adjacent member an overhanging portion that extends, when viewed in cross section, over and beyond the positioning of the adjacent runner to act as a stabilizer. The overhanging portion will extend for the full longitudinal length of the assembly, and will have the major portion thereof at the bottom of the assembly. Each water walker also includes either an elongated indentation or a correspondingly shaped elongated protuberance on the respective side thereof facing the adjacent member so as to be interconnecting and thus limit vertical movement between the two members, and the pair of water walkers are also interconnected by a looped pair of cables, each being respectively connected to the top of a respective member, so as to limit diverging movement therebetween in a sideways direction. The limiting of respective movements between the water walkers in both the vertial and sideways direction greatly enhances the stability of operation of the walkers: the limiting of vertical movement will result in a more even weight distribution by the user on the two walkers and thus reduce loss of balance possibilities and the limiting of sideways movement will result in a reduced probability of excessive walker separation (with concurrent risk of user groin muscle stretching).

The invention will now be better understood by reference to the accompanying drawings.

DESCRIPTION OF THE PREFERRED EMBODIMENTS

Figure 1:
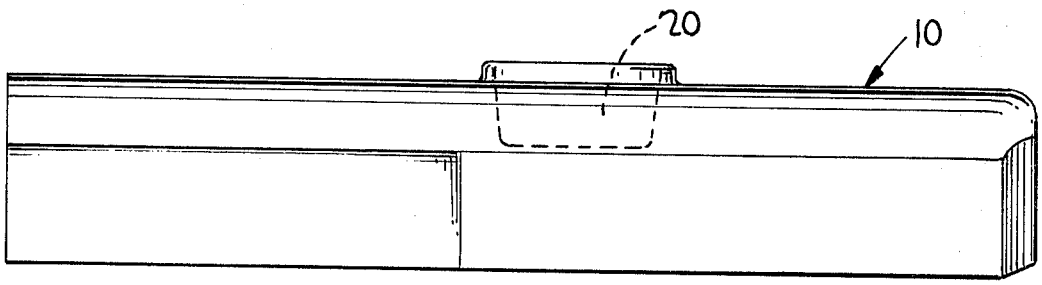
FIG. 1 is a side elevational view of a water walker assembly in accordance with the present invention.
Figure 2:
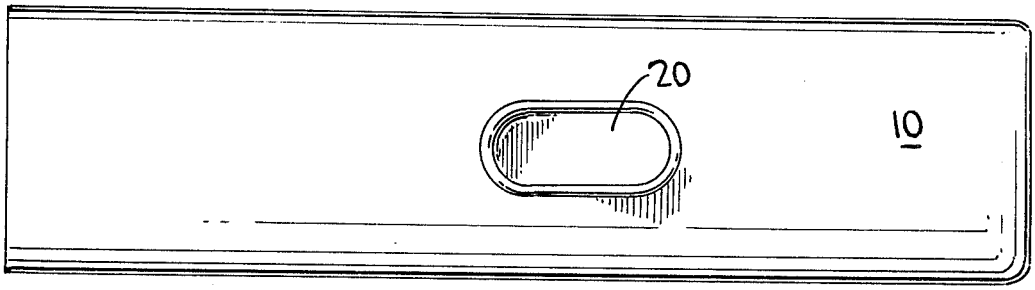
FIG. 2 is a top plan view of the water walker assembly illustrated in FIG. 1.
Figure 3:
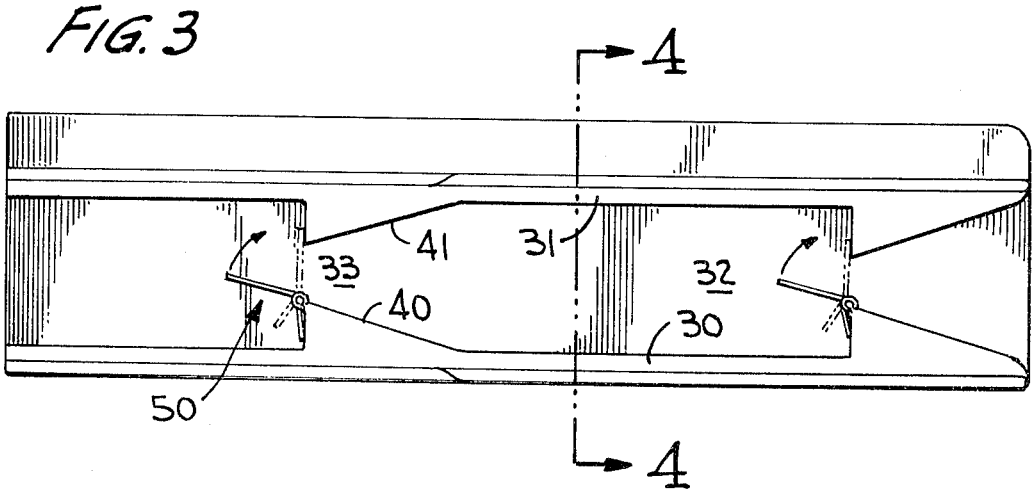
FIG. 3 is a bottom plan view of the water walker assembly illustrated in FIG. 1.

Each of the water walker assemblies in accordance with the present invention has a side view generally as illustrated in FIG. 1. A water walker assembly for use on a user's right foot is shown in FIGS. 2 and 3. Each assembly, whether it be for a user's left foot or right foot, comprises a buoyant member 10 which has a top portion, a bottom portion and side portions. Appropriately located in the top portion is a cavity 20 which is provided with straps or other means (not shown) to secure or attach the water walker to the foot of the user. Positioned in opposed, spaced apart fashion along the bottom of the assembly are runner members 30, 31 which extend along the entire length of the walker assembly and which define therebetween a hollow channel 32. Specific features of the runner members can be found in my co-pending application Ser. No. 792,571, the discussion of which is herein incorporated by reference.

The inventive control mechanisms for enabling the water walker assemblies to move in a forward direction while retarding their movement in a rearward direction so as to prevent slippage are best illustrated in FIG. 3 (wherein two individual mechanisms are shown).

Each mechanism includes hollow baffle means 40, 41 which are respectively attached to (or formed as part of) the runner members 30, 31 at corresponding positions along the longitudinal direction thereof such that they are opposed to one another, and a gate means 50 which is attached to baffle means 40 and which is movable from a first position to a second position as shown in FIG. 3 (the "first" position being shown in solid lines and the "second" position being shown in broken lines). Each of the baffle means is shown to be triangularly shaped, with the hypotenuse sides of each facing the front of the water walker assembly, and neither extends towards one another more than half the distance between the runner members 30, 31. In this way a passageway 33 is left between the baffles 40, 41 and thus the water which may pass from the front of the assembly to the rear, i.e., when the assembly is moved forward (i.e. from right to left in FIG. 3), will undergo a venturi acceleration through passageway 33.

Figure 6:
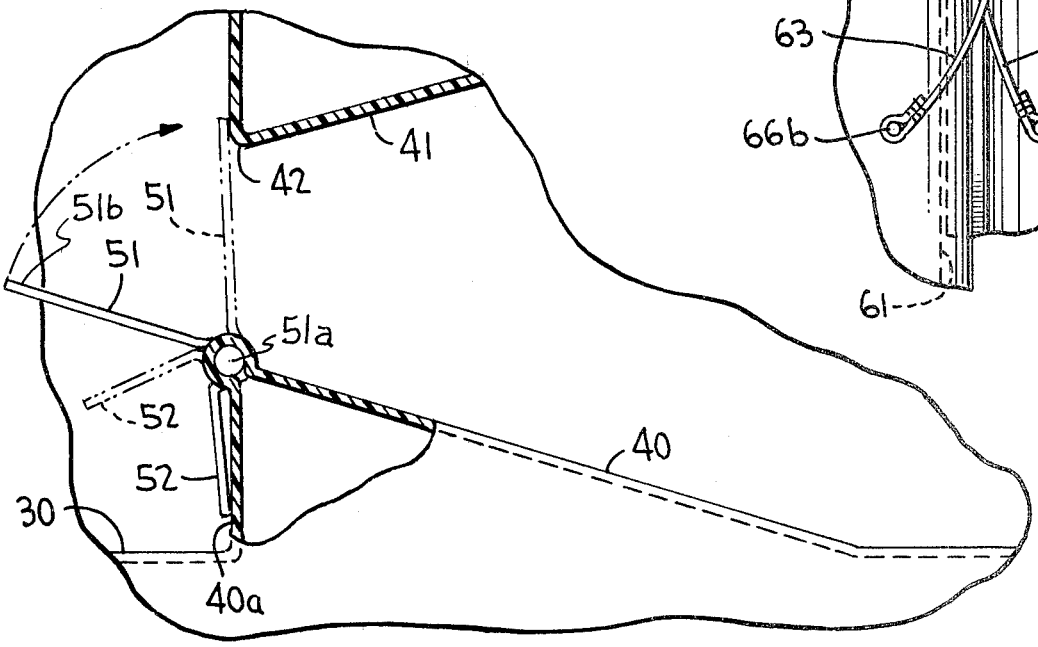
FIG. 6 is an exploded view of one embodiment of a gate which is operable to close the passageway between opposed baffles positioned on the bottom of a water walker assembly according to the present invention.

As shown in more detail in FIG. 6, gate means 50 comprises a rectangular plate 51 pivotally hinged at 51*a* to the base side of baffle means 40, the plate including a biasing means in the form of an extension portion 52 which is angled away from the plane defined by plate 51 such that it tends to bias the tip 51*b* of plate 51 towards tip 42 of baffle means 41, i.e., when plate 51 is in its first (furthermost counter-clockwise) position the extension portion will contact the rearward or base side 40*a* of means 40 under slight tension. Although the biasing means 52 is shown as being an extension portion of plate 51, it may also take other forms as would be obvious to those of skill in the art. The only requirement is that the biasing means be capable of biasing the plate 51 from a first position as generally shown in solid lines in FIG. 2 towards a second position as indicated in broken lines in FIG. 2, such that at the time when the pressure exerted thereon by the water flowing through passageway 33 ceases, e.g., when the water walker is no longer being pushed forward by the user's foot, the tip of plate 51 will be immediately swung towards tip 42.

The operation of each control mechanism will be as follows. When the user of the water walker moves his foot forward, the attached water walker assembly will be moved forward and water will concurrently be forced to flow through hollow channel 32 and accelerate through passageways 33. This action will force plate 51 to its open or first position (illustrated in FIGS. 2 and 4). A small braking effect, however, on forward movement of the assembly will be produced both by the vacuum effect created behind and downstream of each of baffles 40, 41, and by the bouncing off of some water from the front facing hypoteneus sides of baffles 40, 41. Just at the time when the user's foot has reached its forwardmost positioning, such that the relative movement of water through hollow section 32 is just about completed, the control mechanism will operate to prevent rearward slippage of the assembly as follows.

Due to the vacuum effect generated behind each of the baffles 40, 41, as well as bouncing off of some of the water which impacts with the front facing portions of baffles 40, 41, at the point where the forward movement of the assembly is completed by the user, a small amount of water momentum in the opposite direction, i.e., from the rear of the assembly to the front of the assembly, will be generated. At the same time, the biasing means 52 will cause the plate 51 to commence swinging towards baffle 41. The combination of reverse water momentum generated by the baffles and the biasing action means 52 will cause plates 51 to tend to close passageway 33 much more quickly than control mechanisms known to the prior art.

In this way, the plate 51 will very quickly move to its second position, i.e., against the tip 42 of baffle means 41, and thus rearward movement of the assembly will be prevented more quickly than known to the prior art. This increases the stability of the assembly as a whole.

Figure 4:
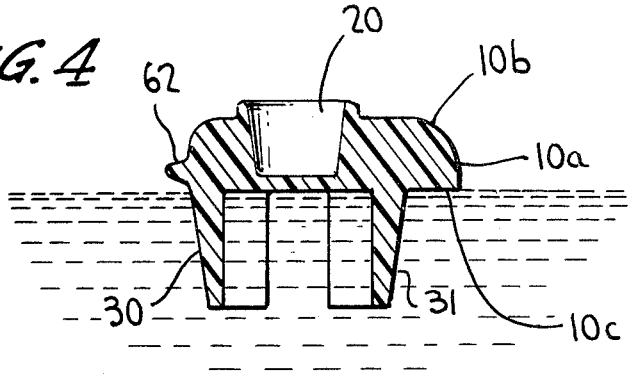
FIG. 4 is a cross-sectional view of the water walker assembly taken along line 4—4 of FIG. 3.
Figure 5:
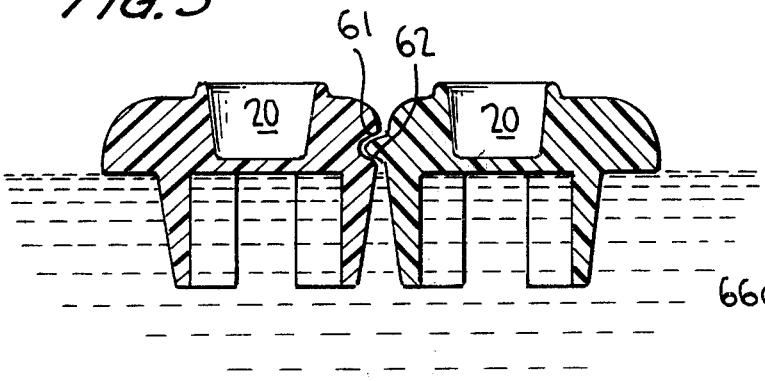
FIG. 5 is a cross-sectional view of two water walkers in accordance with the present invention, viewed from the rear to show respective left and right foot assemblies, each cross-section taken along the equivalent of line 4—4 in FIG. 3.

A further stabilizing feature of the water walker assembly of the present invention is shown best in FIGS. 4 and 5. As can be seen in FIG. 4, the right-hand side of the assembly is fabricated so as to have an overhang portion 10*a*, this overhang portion comprising the same buoyant material as the rest of the assembly 10. The overhang portion is formed as a quarter cylinder, i.e., so as to have, in cross section, a radial section 10*b* and a bottom flat section 10*c*. Flat section 10*c* is essentially planar with the bottom of the water walker assembly to which the runners 30, 31 are connected, which is generally at the water line of the water walker when floating by itself. The radius of section 10*b* may be, for example, 5 inches, and the flat section 10*c* may extend away from the adjacent runner by about 3 inches. The water walker assembly adapted to be fitted onto the right foot of a user will have the overhang portion of the right hand side of the assembly, whereas the water walker assembly adapted to be fitted onto the left foot of the user will have the overhang portion on the left hand side, e.g., as shown in FIG. 5, so as to facilitate relative (walking) movement of the two assemblies without interference.

Figure 7:
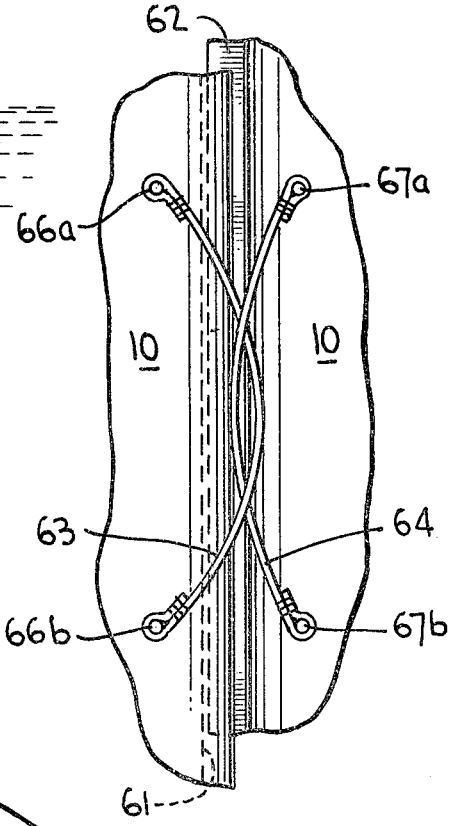
FIG. 7 is a top plan view of a portion of two water walker assemblies interconnected by a pair of cables for controlling the relative sideways movement of the assemblies.

Further stabilizing features of the invention is shown in FIGS. 4, 5 and 7. As shown in FIG. 5, each walker includes either an elongated indentation 61 or a correspondingly shaped elongated protuberance 62 on the respective side facing the adjacent walker which coact to control relative vertical movement between the two walkers. A pair or interconnected looped cables 63, 64 (see FIG. 7) which are respectively connected to means 66*a*, 66*b* and 67*a*, 67*b* on the walkers, act to not only prevent sideways movement between the walkers, but also to limit relative forward and reverse movement therebetween. The cables are of such length as to maintain protuberance 62 at least half way within indentation 61.

It should be recognized that the foregoing description and the accompanying drawings are provided merely to present exemplary embodiments of the present invention and that additional modifications of such embodiments are possible within the scope of this invention without deviating from the spirit thereof.

I claim:

1. An apparatus for enabling an individual to both stand and propel himself along the surface of a body of water which comprises a pair of water walker assemblies which each include:

a buoyant flotation member having a top surface, two side surfaces and a bottom surface;

means forming a cavity in said top surface of said member for a user's foot to be placed therein;

two opposed, spaced apart runners longitudinally positioned along said bottom surface of said member so as to form a hollow channel therebetween and having an open front end and an open back end;

at least one control mechanism positioned with said hollow section, each said control mechanism comprising a set of opposed, triangle-shaped baffle means which are respectively connected to said runners such that the hypoteneuse side of each baffle means of each set will face the open front end of the hollow channel, each triangle-shaped baffle means of each set extending towards one another less than one half the distance between said runners so as to leave a respective passageway therebetween;

a gate means in the form of a rectangular plate pivotally connected along one side by a hinge to the base side of one of said triangle-shaped baffle means of each set so as to be movable between a first position wherein the respective passageway is essentially unblocked to the passage of water therethrough and a second position wherein the respective passageway is completely blocked to the passage of water therethrough; and means for biasing each gate means towards said second positioning thereof so as to accelerate closing of the respective passageway once forward motion of said assembly has been completed, and to quickly prevent rearward slippage thereof, said biasing means comprising an extension portion connected to said respective rectangular plate so as to be angled away from a plane defined by the plate, and operating such that when each said rectangular plate is swung so as to unblock said respective hollow channel to the flow of water, each said extension portion will be biased against said respective triangle-shaped baffle means base side.

2. An apparatus in accordance with claim 1 wherein each said baffle means is hollow.

3. An apparatus for enabling an individual to both stand and propel himslef along the surface of a body of water which comprises a pair of water walker assemblies which each include:

a buoyant flotation member having a top surface, two side surfaces and a bottom surface;

means forming a cavity in said top surface of said member for a user's foot to be placed therein;

two opposed, spaced apart runners longitudinally positioned along said bottom surface of said member so as to form a hollow channel therebetween and having an open front end and an open back end;

at least one control mechanism positioned within said hollow section, each said control mechanism comprising a set of opposed baffle means which are respectively connected to said runners, each baffle means of each set extending towards one another less than one half the distance between said runners so as to leave a respective passageway therebetween;

a gate means pivotally connected to one of said baffle means of each set so as to be movable between a first position wherein the respective passageway is essentially unblocked to the passage of water therethrough and a second position wherein the respective passageway is completely blocked to the passage of water therethrough;

means for biasing each gate means towards said second positioning thereof so as to accelerate closing of the respective passageway once forward motion of said assembly has been completed, and to quickly prevent rearward slippage thereof;

each water walker assembly of said pair of water walker assemblies including on the side opposite the adjacent assembly an overhang portion which extends outwardly in the form of a quarter cylinder to act as a stabilizer;

one water walker assembly of said pair of water walker assemblies including on the side facing the adjacent assembly an elongated indentation and the other assembly a correspondingly shaped elongated protrusion, said indentation and protrusion reacting to control relative vertical movement between said pair of walker assemblies; and each water walker of a pair of water walker assemblies iincluding a cable attached to the top surface thereof, the two cables being interconnectedly looped so as to prevent sideways movement between the two assemblies, to limit relative forward and reverse movement therebetween, and to assure coaction of said elongated indentations and said elongated protrusions.

* * * * *